US010557229B2

(12) United States Patent
Yu et al.

(10) Patent No.: US 10,557,229 B2
(45) Date of Patent: Feb. 11, 2020

(54) BLOCKAGE DETECTION IN A DRYER APPLIANCE

(71) Applicant: Haier US Appliance Solutions, Inc., Wilmington, DE (US)

(72) Inventors: Zhiquan Yu, Mason, OH (US); Jeffrey Alan Kern, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 87 days.

(21) Appl. No.: 15/927,208

(22) Filed: Mar. 21, 2018

(65) Prior Publication Data

US 2019/0292716 A1 Sep. 26, 2019

(51) Int. Cl.
*D06F 58/28* (2006.01)

(52) U.S. Cl.
CPC ..... *D06F 58/28* (2013.01); *D06F 2058/2858* (2013.01); *D06F 2058/2864* (2013.01)

(58) Field of Classification Search
None
See application file for complete search history.

(56) References Cited

U.S. PATENT DOCUMENTS

| | | | | |
|---|---|---|---|---|
| 2,960,780 | A | 11/1960 | Stilwell, Jr. | |
| 7,681,420 | B2 * | 3/2010 | Jeong | D06F 25/00 68/12.01 |
| 8,429,833 | B2 | 4/2013 | Harpenau | |
| 8,997,377 | B2 * | 4/2015 | Kim | D06F 58/22 34/610 |
| 10,181,245 | B2 * | 1/2019 | Krula | G08B 19/00 |
| 2009/0119943 | A1 * | 5/2009 | Grunert | D06F 58/206 34/513 |
| 2009/0151192 | A1 | 6/2009 | Nawrot | |

FOREIGN PATENT DOCUMENTS

KR 20070082390 A 8/2007

* cited by examiner

*Primary Examiner* — David J Laux
(74) *Attorney, Agent, or Firm* — Dority & Manning, P.A.

(57) ABSTRACT

A dryer appliance and a method of operating the same to detect blockages are provided. The dryer appliance includes an exhaust conduit that defines a flow restriction and is in fluid communication with a drying chamber. A differential pressure sensor is operably coupled to the exhaust conduit at the flow restriction and a controller is configured for using a measured pressure differential to obtain an air flow rate and determine whether a blockage is present in the exhaust conduit, e.g., by comparing the measured flow rate to a baseline, zero-blockage flow rate.

20 Claims, 5 Drawing Sheets

BLOCKAGE DETECTION IN A DRYER APPLIANCE

FIELD OF THE INVENTION

The present subject matter relates generally to dryer appliances, and more particularly to systems and method for detecting venting blockages in dryer appliances.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, an air handler or blower is utilized to flow the internal air from the vent duct to the exhaust duct. When operating, the blower may pull air through itself from the vent duct, and this air may then flow from the blower to the exhaust conduit.

Although dryer appliances often include filter systems to prevent foreign materials, such as lint, from passing into the exhaust conduit, it is difficult for such systems to prevent all foreign materials from entering the exhaust conduit. Although lint may be driven from the exhaust while the blower is operating, suspended lint may fall and rest within the exhaust once the blower ceases to operate. If permitted to accumulate within the exhaust conduit, such foreign materials may impair dryer performance. For instance, accumulated lint may restrict the effective operating size of the passages through which air flows during operation. Restrictions can prevent proper airflow, thereby hindering drying of articles. In more severe cases, the collection of lint may present a fire hazard due to the potential for combustion.

Accordingly, improved dryer appliances and methods for detecting venting blockages are desirable. More particularly, dryer appliances including simple, cost effective, and reliable means for detecting clogs would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a dryer appliance is providing including a cabinet and a drum rotatably mounted within the cabinet, the drum defining a drying chamber for receipt of clothes for drying. An exhaust conduit defines an exhaust passage in fluid communication with the drying chamber, the exhaust conduit defining a flow restriction. An air handler is operably coupled to the exhaust conduit for urging a flow of air through the exhaust passage. A differential pressure sensor is operably coupled to the exhaust conduit, the differential pressure sensor including an upstream conduit fluidly coupled to the exhaust conduit upstream of the flow restriction and a downstream conduit fluidly coupled to the exhaust conduit proximate the flow restriction. A controller is operably coupled to the differential pressure sensor, the controller being configured for detecting a blockage within the exhaust passage.

In another aspect of the present disclosure, a method of operating a dryer appliance is provided. The dryer appliance includes a drum defining a drying chamber, an exhaust conduit that defines a flow restriction in fluid communication with the drying chamber, and a differential pressure sensor operably coupled to the exhaust conduit at the flow restriction. The method includes urging a flow of air through the exhaust passage, measuring a pressure differential using the differential pressure sensor, and determining whether a blockage is present in the exhaust passage based on the measured pressure differential.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
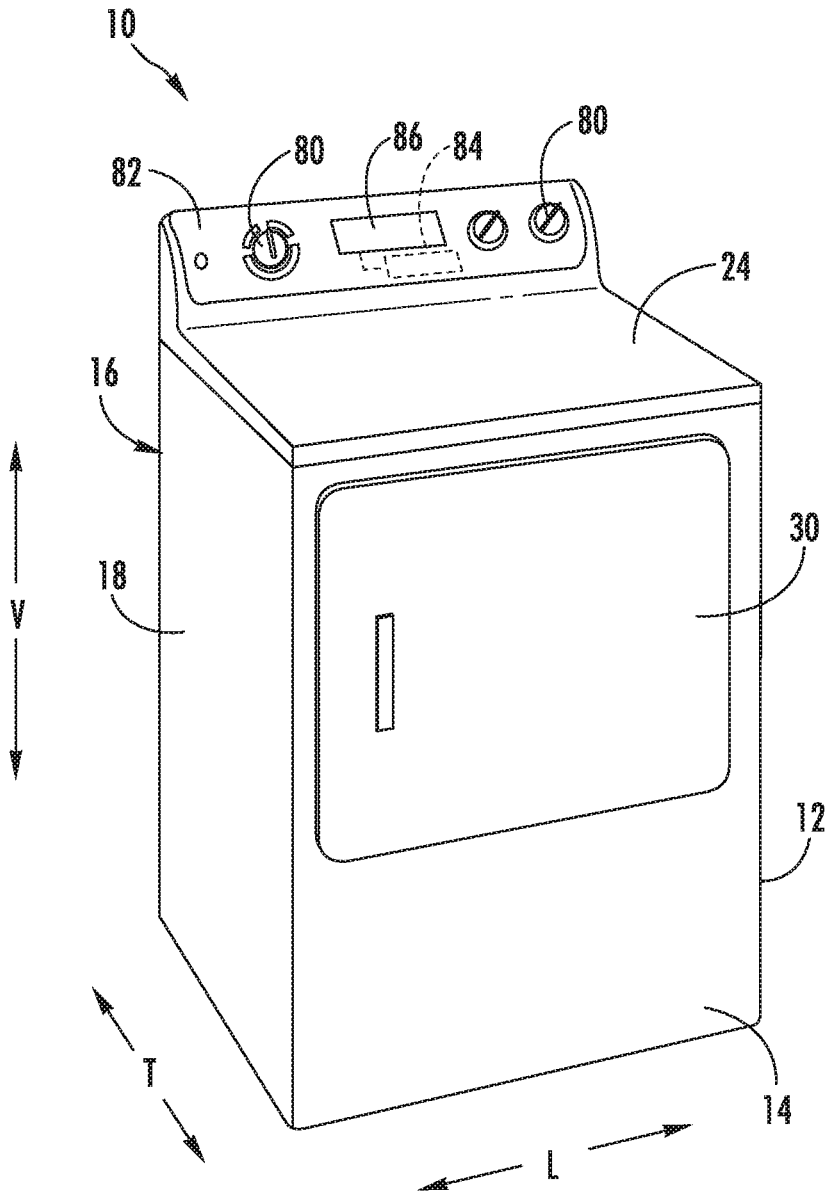
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
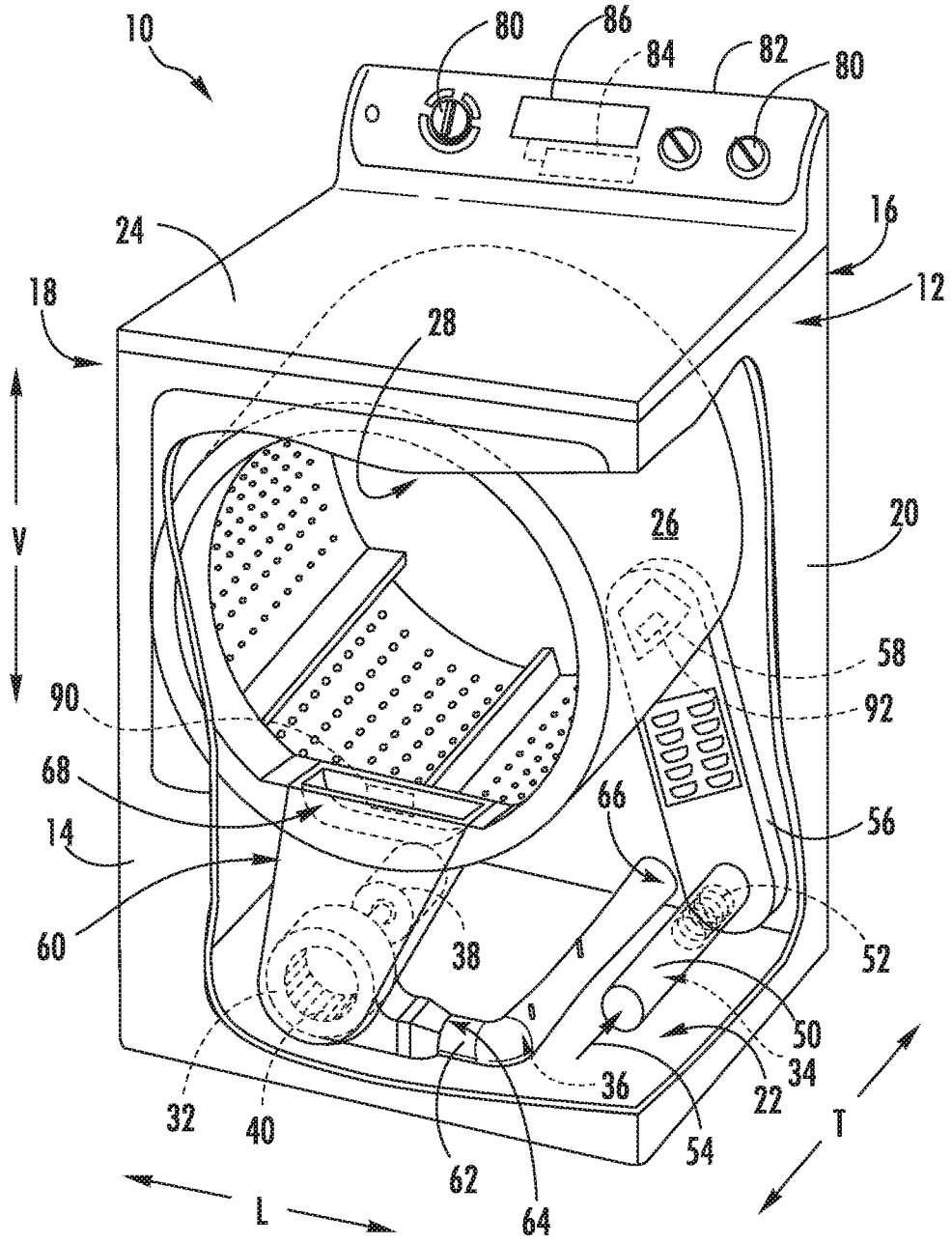
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with drying chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a vent duct 60, air handler 32, and an exhaust conduit 62. Exhaust conduit 62 is in fluid communication with vent duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through vent duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, vent duct 60 may include a filter portion 68 which includes a screen filter or other suitable device for removing lint and other particulates as internal air is drawn out of drying chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet backsplash 82. Display 86 may be in communication with controller 84, and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors 90. Temperature sensor 90 is generally operable to measure internal temperatures in dryer appliance 10. In some embodiments, temperature sensor 90 is disposed proximal to an outlet of drum 26 (e.g., within vent duct 60). In additional or alternative embodiments, a temperature sensor 90 is disposed along exhaust conduit 62, in thermal communication therewith. For example, temperature sensor 90 may extend at least partially within passage 36 to measure the temperature of air therethrough. In further additional or alternative embodiments, a temperature sensor 90 may be disposed at any other suitable location within dryer appliance 10 to detect the temperature of airflow (e.g., downstream from chamber 28). Temperature sensor 90 may be embodied as a thermistor, thermocouple, or any other suitable sensor for detecting a specific temperature value of air within appliance 10. When assembled, temperature sensor 90 may be in communication with (e.g., electrically coupled to) controller 84, and may transmit readings to controller 84 as required or desired.

In some embodiments, controller 84 is configured to vary operation of heating assembly 50 based on one or more temperatures detected at temperature sensor 90. For instance, controller 84 may automatically set or adjust one or more criteria for activation heating assembly 50 without an estimation of ambient conditions by a user. Specifically, controller 84 may determine an ambient temperature and set or adjust a threshold criterion accordingly. During use, controller 84 can initiate a temperature-contingent dryer cycle wherein a determination about the ambient conditions (e.g., ambient air temperature) is made, and operation of the appliance 10 is modified accordingly.

Figure 3:
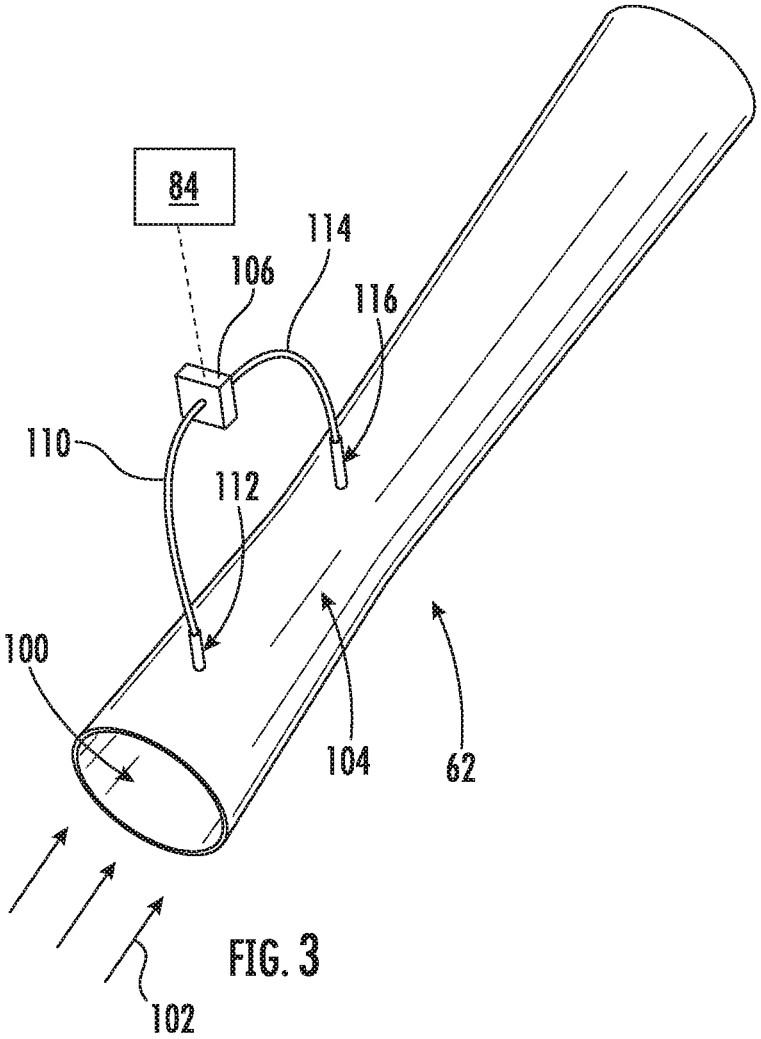
FIG. 3 provides a perspective view of an exhaust duct that may be used with the exemplary dryer appliance of FIG. 1 according to an exemplary embodiment of the present subject matter.
Figure 4:
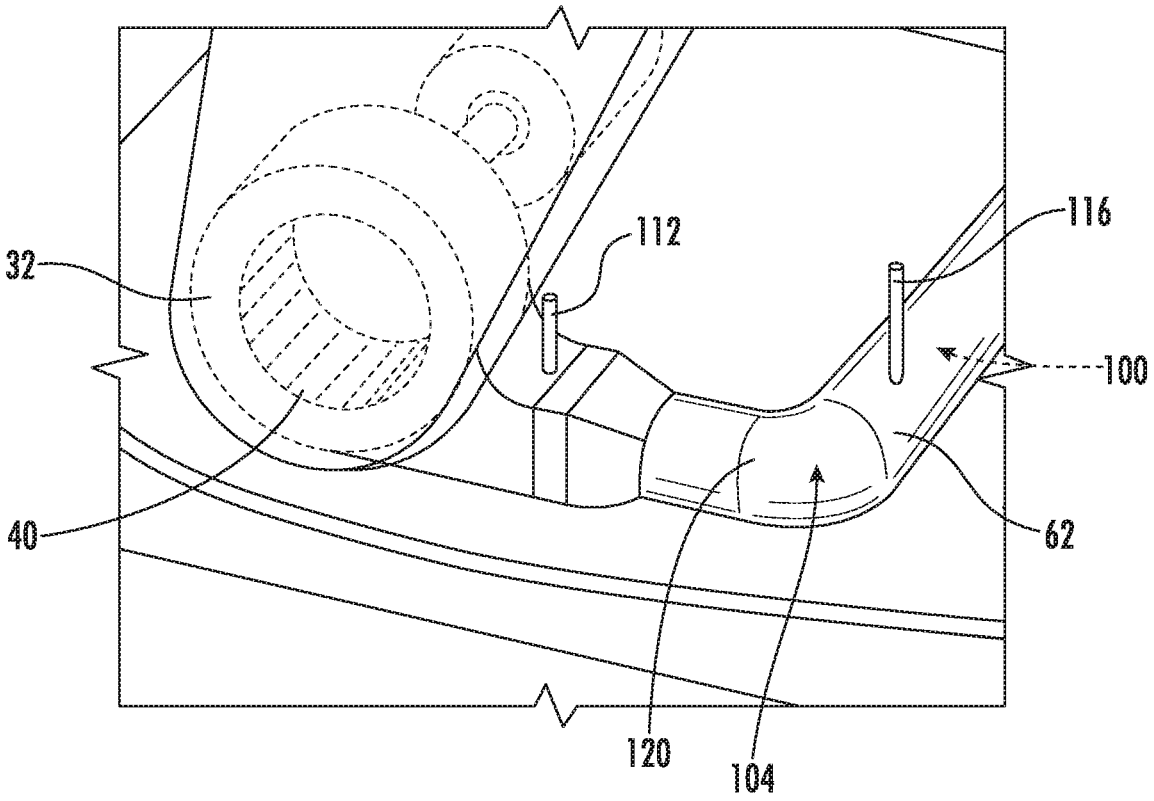
FIG. 4 provides a close-up perspective view of an exhaust duct mounted within the exemplary dryer appliance of FIG. 1 according to an alternative embodiment of the present subject matter.

Referring now to FIGS. 2 through 4, a system and method for monitoring the air flow rate and detecting blockages within exhaust conduit 62 will be described according to an exemplary embodiment of the present subject matter. Although described for detecting blockages in exhaust conduit 62, it should be appreciated that aspects of the present subject matter may be used for detecting blockages in any other suitable duct of any other suitable appliance. The exemplary embodiment described herein is not intended to limit the scope of the present subject matter.

As illustrated, exhaust conduit 62 generally defines an exhaust passage 100 through which a flow of exhaust air (indicated by arrow 102) is urged by air handler 32. Further, exhaust conduit 62 comprises or defines a flow restriction 104. As used herein, the term "flow restriction" is used to refer to a characteristic within exhaust conduit 62 or exhaust passage 100 that has a tendency to decrease the air flow rate through exhaust passage 100. Specifically, flow restriction 104 may constrict flow to the extent that the resulting pressure drop (e.g., a specific predetermined percentage such as less than 10% restriction) may be measured by a differential pressure sensor 106. In this regard, dryer appliance 10 may include differential pressure sensor 106 for measuring the pressure drop and determining a flow rate based on the pressure drop resulting from flow restriction 104.

According to the illustrated embodiment of FIG. 3, flow restriction 104 may be achieved by forming exhaust conduit 62 to define a Venturi passage. In this regard, the Venturi-shaped or necked portion of exhaust conduit 62 is intended to cause the Venturi effect. In this regard, the Venturi effect generally refers to the reduction in fluid pressure that results when a fluid flows through a restriction or constricted section of a fluid conduit. As described below, the pressure reduction may be used to determine the flow rate through the conduit using Bernoulli's principle, which states that a fluid's speed is inversely proportional to its pressure, so decreasing the pressure of the gas with a known constriction and measuring the differential pressure yields a flow measurement.

Specifically, referring to FIG. 3, an upstream conduit 110 fluidly coupling a first tap 112 to one side of differential pressure sensor 106 and a downstream conduit 114 fluidly coupling a second tap 116 to an opposite side of differential pressure sensor 106. In this manner, as the flow of exhaust air 102 passes through exhaust passage 100, differential pressure sensor 106 may detect the pressure drop through the flow restriction, and controller 84 may determine a flow rate from that pressure drop.

Although flow restriction 104 is described above as a Venturi, other means for achieving flow restriction 104 may be used according to alternative embodiments. For example, an orifice plate may be positioned within exhaust passage 100 which defines an orifice having a reduced diameter relative to the exhaust conduit 62 diameter. Alternatively, a nozzle may be positioned within exhaust conduit 62 to achieve the desired flow restriction 104. According to still another embodiment illustrated in FIG. 4, the flow restriction 104 may be a result of an elbow 120 of exhaust conduit 62. In such an embodiment, first tap 112 is positioned upstream of elbow 120 and second tap 116 is positioned downstream. However, a Venturi-shaped passage is desirable for at least the reason that it reduces the tendency of lint to build up within exhaust conduit 62, e.g., due to the more gradual restriction of the flow and fewer edges where lint may be trapped and collect.

According to an exemplary embodiment, controller 84 may determine that a blockage exists when the pressure differential drops a predetermined percentage relative to the baseline. In this regard, for example, Table 1 below provides exemplary duct sizes, differential pressures (in inches of water), and the corresponding percent blockage. In the table below, the percent blockage is calculated as the blocked cross sectional area (i.e., the difference between the unblocked cross sectional area and the cross sectional area after the blockage) over the unblocked cross sectional area.

TABLE 1

Pressure Differential vs. Percent Blockage

| Duct Condition | Flow Area | Pressure Differential (inches $H_20$) | Percent Blockage |
|---|---|---|---|
| Unblocked | 3.9" | 0.33 in. | 0% |
| Partially Blocked | 2.875" | 0.15 in. | 26.3% |
| Heavily Blocked | 1.5" | 0.05 in. | 61.5% |
| Fully Blocked | 0" | 0.00 in. | 100% |

A user or manufacturer of dryer appliance may program controller 84 to determine that a blockage exists when the measured pressure differential corresponds to a percent blockage that exceeds a predetermined blockage threshold. In this regard, controller 64 may contain a lookup table that correlates the pressure differential to the percent blockage, e.g., using empirical values. The predetermined blockage threshold may be, for example, 20%, 40%, 50%, 60%, or any other suitable percentage. The determination may also rely on a comparison between a baseline air flow rate (e.g., the flow rate at zero blockage) to an actual air flow rate, as described in more detail below.

Now that the construction and configuration of dryer appliance 10 according to an exemplary embodiment of the present subject matter has been presented, an exemplary method 200 for operating a dryer appliance according to an exemplary embodiment of the present subject matter is provided. Method 200 can be used to operate dryer appliance 10, or any other suitable dryer appliance. In this regard, for example, controller 84 may be configured for implementing method 200. However, it should be appreciated that the exemplary method 200 is discussed herein only to describe exemplary aspects of the present subject matter, and is not intended to be limiting.

Figure 5:
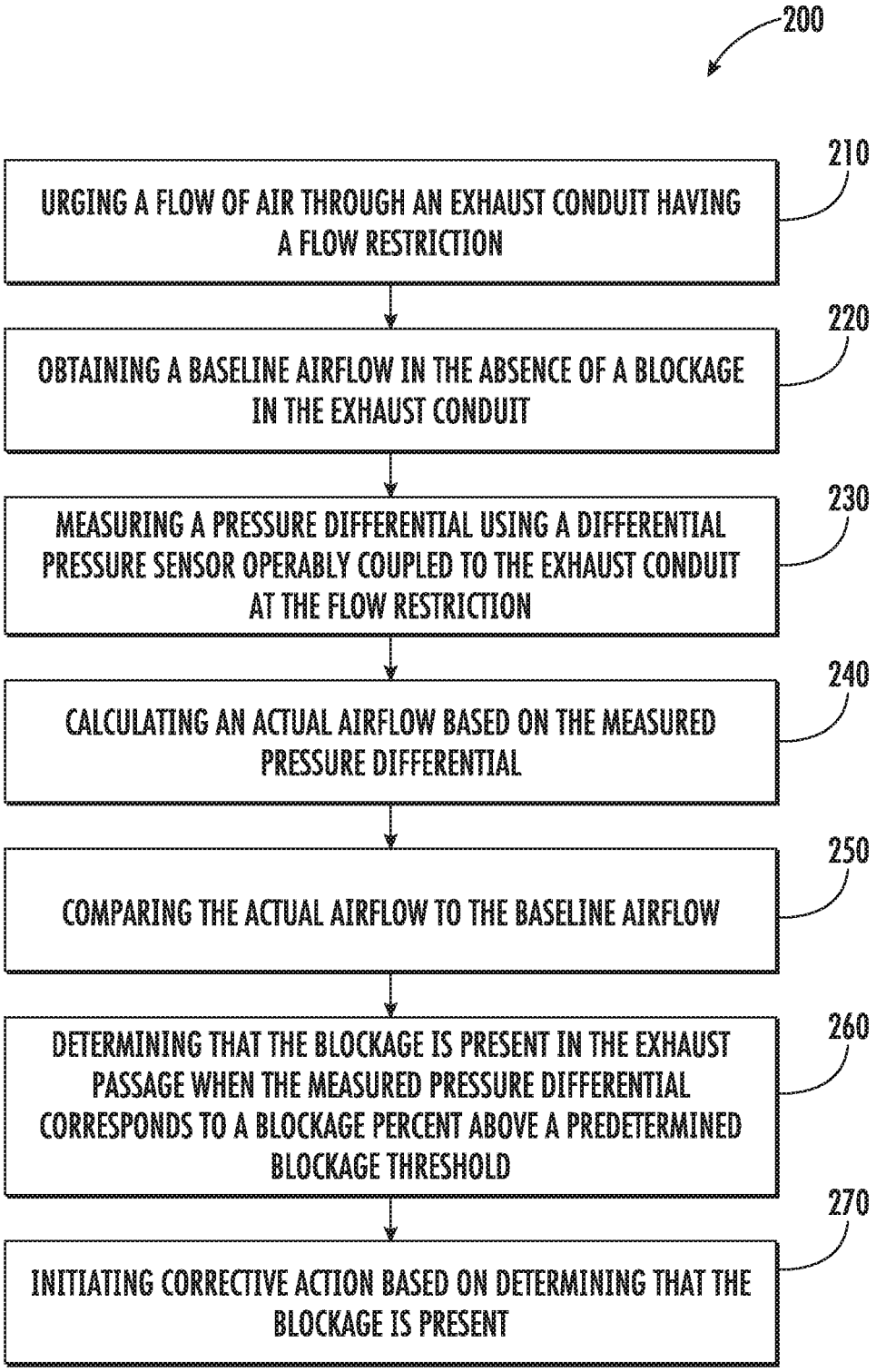
FIG. 5 is a method of operating a dryer appliance in accordance with one embodiment of the present disclosure.

Referring now to FIG. 5, method 200 includes, at step 210, urging a flow of air through an exhaust conduit having a flow restriction. For example, air handler 32 may urge the flow of exhaust air 102 through exhaust conduit 62 which defines a Venturi-shaped flow restriction 104. Step 220 includes obtaining a baseline airflow in the absence of a blockage in the exhaust conduit. The baseline air flow may be determined, e.g., when dryer appliance is new (prior to any lint accumulation), may be provided by a manufacturer (e.g., via a lookup table), or may be determined in any other suitable manner.

Step 230 includes measuring a pressure differential using a differential pressure sensor operably coupled to the exhaust conduit at the flow restriction and step 240 includes calculating an actual airflow based on the measured pressure differential. Step 250 includes comparing the actual airflow to the baseline airflow and step 260 includes determining that the blockage is present in the exhaust passage when the measured pressure differential corresponds to a blockage percent above a predetermined blockage threshold. For example, as explained above, controller 84 may be configured for determining that a blockage is present if the blockage percent is above 20%, 40%, 60%, etc.

In response to determining that there is a blockage in the exhaust conduit, method 200 may further include, at step 270, initiating corrective action based on determining that the blockage is present. As used herein, "corrective action" refers to any action on part of a user of the appliance (or a technician) or on part of the appliance itself to clear the blockage or prevent hazardous situations resulting from such blockage. For example, initiating corrective action may include providing a user with an indication of the blockage so that they may clear it or call a technician. Alternatively, and particularly if the blockage becomes severe, initiating corrective action may include turning off the dryer appliance until the blockage is cleared.

FIG. 5 depicts an exemplary control method having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using dryer appliance 10 as an example, it should be appreciated that these methods may be applied to the operation of any suitable dryer appliance type and configuration.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a drying chamber for receipt of clothes for drying;

an exhaust conduit defining an exhaust passage, the exhaust conduit having a first cross-sectional area and being in fluid communication with the drying chamber, the exhaust conduit further having a flow restriction having a second cross-sectional area less than the first cross-sectional area;

an air handler operably coupled to the exhaust conduit for urging a flow of air through the exhaust passage;

a differential pressure sensor operably coupled to the exhaust conduit, the differential pressure sensor comprising an upstream conduit fluidly coupled to the exhaust conduit upstream of the flow restriction and a downstream conduit fluidly coupled to the exhaust conduit proximate the flow restriction; and a controller operably coupled to the differential pressure sensor, the controller being configured for detecting a blockage within the exhaust passage.

2. The dryer appliance of claim 1, wherein the flow restriction is formed around an elbow of the exhaust conduit.

3. The dryer appliance of claim 1, wherein the flow restriction is a Venturi-shaped portion within the exhaust duct.

4. The dryer appliance of claim 1, wherein the flow restriction is formed using an orifice plate or a nozzle positioned within the exhaust passage.

5. The dryer appliance of claim 1, wherein the flow restriction comprises a section of exhaust conduit that has less than a predetermined percent reduction in cross sectional area.

6. The dryer appliance of claim 1, wherein the exhaust conduit extends from an inlet at the drying chamber to an outlet defined through the cabinet.

7. The dryer appliance of claim 1, wherein detecting the blockage comprises:

operating the air handler to urge a flow of air through the exhaust passage;

measuring a pressure differential between the upstream conduit and the downstream conduit using the differential pressure sensor; and determining whether a blockage is present in the exhaust passage based on the measured pressure differential.

8. The dryer appliance of claim 7, wherein determining the blockage is present comprises:

obtaining a baseline airflow in the absence of the blockage;

calculating an actual airflow based on the measured pressure differential; and comparing the actual airflow to the baseline airflow.

9. The dryer appliance of claim 7, wherein the blockage is present when the measured pressure differential corresponds to a blockage percent above a predetermined blockage threshold.

10. The dryer appliance of claim 9, wherein the predetermined blockage threshold is a 40% blockage.

11. The dryer appliance of claim 7, wherein the controller is further configured for initiating corrective action based on determining that the blockage is present.

12. The dryer appliance of claim 11, wherein initiating corrective action comprises providing a user with an indication of the blockage.

13. The dryer appliance of claim 11, wherein initiating corrective action comprises turning off the dryer appliance until the blockage is cleared.

14. A method of operating a dryer appliance, the dryer appliance comprising a drum defining a drying chamber, an exhaust conduit having a first cross-sectional area, the exhaust conduit further having a flow restriction having a second cross-sectional area less than the first cross-sectional area, the exhaust conduit being in fluid communication with the drying chamber, and a differential pressure sensor operably coupled to the exhaust conduit at the flow restriction, the method comprising:

urging a flow of air through the exhaust passage;

measuring a pressure differential using the differential pressure sensor; and determining whether a blockage is present in the exhaust passage based on the measured pressure differential.

15. The method of claim 14, wherein determining the blockage is present comprises:

obtaining a baseline airflow in the absence of the blockage;

calculating an actual airflow based on the measured pressure differential; and comparing the actual airflow to the baseline airflow.

16. The method of claim 14, wherein the blockage is present when the measured pressure differential corresponds to a blockage percent above a predetermined blockage threshold.

17. The method of claim 16, wherein the predetermined blockage threshold is a 40% blockage.

18. The method of claim 14, further comprising:

initiating corrective action based on determining that the blockage is present.

19. The method of claim 18, wherein initiating corrective action comprises providing a user with an indication of the blockage.

20. The method of claim 18, wherein initiating corrective action comprises turning off the dryer appliance until the blockage is cleared.

* * * * *